US010001793B2

(12) United States Patent
Chu et al.

(10) Patent No.: US 10,001,793 B2
(45) Date of Patent: Jun. 19, 2018

(54) APPARATUSES AND METHODS FOR PROVIDING CONSTANT CURRENT

(71) Applicant: Micron Technology, Inc., Boise, ID (US)

(72) Inventors: Wei Lu Chu, Shanghai (CN); Dong Pan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 141 days.

(21) Appl. No.: 14/772,757

(22) PCT Filed: Jul. 28, 2015

(86) PCT No.: PCT/CN2015/085267
§ 371 (c)(1),
(2) Date: Sep. 3, 2015

(87) PCT Pub. No.: WO2017/015850
PCT Pub. Date: Feb. 2, 2017

(65) Prior Publication Data
US 2017/0227975 A1 Aug. 10, 2017

(51) Int. Cl.
*G05F 3/16* (2006.01)
*G05F 1/46* (2006.01)
*G05F 1/575* (2006.01)
*G05F 1/59* (2006.01)

(52) U.S. Cl.
CPC ..... *G05F 1/468* (2013.01); *G05F 1/461* (2013.01); *G05F 1/575* (2013.01); *G05F 1/59* (2013.01)

(58) Field of Classification Search
CPC ..... H03K 5/24; H03K 5/003; H03K 3/011; G05F 3/30; G05F 1/465; Y10S 23/901
USPC ..... 323/311–316; 327/64, 143, 308, 309, 327/525, 539, 541
See application file for complete search history.

(56) References Cited

U.S. PATENT DOCUMENTS 4,035,693 A 7/1977 Luxa et al.
4,857,823 A * 8/1989 Bitting ..... G05F 3/267 323/314
4,970,415 A 11/1990 Fitzpatrick et al.
6,087,820 A 7/2000 Houghton et al.
(Continued)

FOREIGN PATENT DOCUMENTS

CN 1271116 A 10/2000
CN 101650997 A 2/2010
(Continued)

OTHER PUBLICATIONS

International Search Report and Written Opinion received for PCT/CN2015/085267 dated Mar. 31, 2016.
(Continued)

*Primary Examiner* — Rajnikant Patel
(74) *Attorney, Agent, or Firm* — Dorsey & Whitney LLP

(57) ABSTRACT

An apparatus is described comprising a bandgap reference circuit comprising: an amplifier including first and second inputs and an output; and a bandgap transistor coupled to the output of the amplifier at a control electrode thereof, the bandgap transistor being further coupled commonly to the first and second inputs of the amplifier at a first electrode thereof to form a feedback path. The apparatus further comprises a resistor coupled to the first electrode of the bandgap transistor.

15 Claims, 7 Drawing Sheets

(56) References Cited

U.S. PATENT DOCUMENTS

| | | | | |
|---|---|---|---|---|
| 7,274,180 | B2 * | 9/2007 | Itoh | G05F 1/575 323/268 |
| 7,385,453 | B2 * | 6/2008 | Nervegna | H03K 3/011 331/111 |
| 7,514,987 | B2 * | 4/2009 | Lin | G05F 3/30 323/313 |
| 7,636,010 | B2 * | 12/2009 | Huang | G05F 3/30 327/539 |
| 8,264,214 | B1 * | 9/2012 | Ratnakumar | G05F 3/30 323/314 |
| 9,030,186 | B2 * | 5/2015 | Gupta | G05F 3/30 323/314 |
| 2005/0276140 | A1 * | 12/2005 | Ogiwara | G03B 42/02 365/212 |
| 2006/0006927 | A1 * | 1/2006 | Nakada | G05F 3/30 327/539 |
| 2006/0232326 | A1 | 10/2006 | Seitz et al. | |
| 2007/0036016 | A1 | 2/2007 | Takeuchi et al. | |
| 2007/0046341 | A1 | 3/2007 | Tanzawa | |
| 2007/0273407 | A1 | 11/2007 | Ueda | |
| 2008/0284465 | A1 | 11/2008 | Kao | |
| 2009/0121699 | A1 | 5/2009 | Park et al. | |
| 2009/0263110 | A1 | 10/2009 | Elliott et al. | |
| 2010/0171732 | A1 | 7/2010 | Miyazaki | |
| 2011/0057718 | A1 | 3/2011 | Snoeij et al. | |
| 2011/0102127 | A1 | 5/2011 | Schultes et al. | |
| 2011/0193544 | A1 | 8/2011 | Iacob et al. | |
| 2012/0146599 | A1 | 6/2012 | Oyama | |
| 2014/0232363 | A1 | 8/2014 | Ueda | |
| 2014/0340959 | A1 | 11/2014 | Antonyan | |
| 2016/0252920 | A1 | 9/2016 | Chu | |

FOREIGN PATENT DOCUMENTS

| | | | |
|---|---|---|---|
| CN | 103163935 | A | 6/2013 |
| CN | 103681796 | A | 3/2014 |
| EP | 2207073 | A2 | 7/2010 |
| JP | 03228365 | A | 10/1991 |
| JP | 09034566 | A | 2/1997 |
| JP | 2004206633 | A | 7/2004 |
| JP | 2009070132 | A | 4/2009 |

OTHER PUBLICATIONS

Mrmak, et al., Resistor Guide, 2012, Retrieved from http://www.resistorguide.com/materials on Nov. 29, 2017.

* cited by examiner

APPARATUSES AND METHODS FOR PROVIDING CONSTANT CURRENT

RELATED APPLICATIONS

This application is a 371 National Stage application claiming priority to International Application No. PCT/CN2015/085267, filed Jul. 28, 2015, which application is incorporated herein by reference in its entirety and for any purpose.

BACKGROUND

Many electronic circuits are designed for use with a constant current input or bias signal, which may be provided by a constant current source. For example, constant current sources are regularly employed in biasing input buffer circuits, delay circuits, and/or oscillator circuits. Traditional constant current sources employ a bandgap reference circuit using multiple amplifiers. The multiple amplifiers, however, consume substantial power and take up significant space in the circuit. Additionally, multiple amplifier bandgap reference circuits may still suffer from some current variation across operating temperatures.

SUMMARY

An apparatus is described comprising a bandgap reference circuit comprising: an amplifier including first and second inputs and an output; and a bandgap transistor coupled to the output of the amplifier at a control electrode thereof, the bandgap transistor being further coupled commonly to the first and second inputs of the amplifier at a first electrode thereof to form a feedback path. The apparatus further comprises a resistor coupled to the first electrode of the bandgap transistor.

DETAILED DESCRIPTION

Certain details are set forth below to provide a sufficient understanding of embodiments of the invention. However, it will be clear to one skilled in the art that embodiments of the invention may be practiced without these particular details. Moreover, the particular embodiments of the present invention described herein are provided by way of example and should not be used to limit the scope of the invention to these particular embodiments. In other instances, well-known circuits, control signals, timing protocols, and software operations have not been shown in detail in order to avoid unnecessarily obscuring the invention.

Constant current sources provide constant current under a variety of operating conditions. For example, during the operation of a current source, components of the current source may heat up. The change in temperature of the components may alter certain physical properties and result in an output current that changes as the current source heats up. Traditional circuits for generating constant current output signals include bandgap reference circuits. However, traditional bandgap reference circuits typically include multiple amplifiers which, in turn, draw substantial power. Embodiments of the present invention provide constant current sources that may exhibit less temperature dependency and have lower power and space consumption in comparison to traditional constant current sources. The reduced temperature dependency of the current source may be referred to as "temperature independent."

Figure 1:
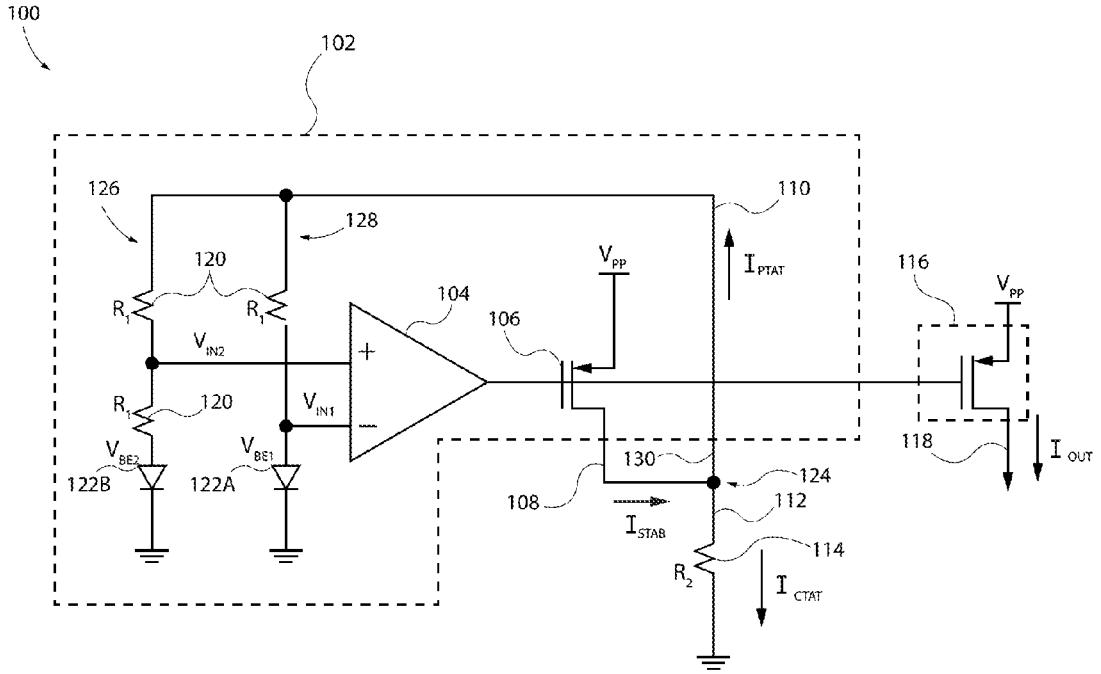
FIG. 1 is a schematic diagram of a constant current source, in accordance with an embodiment of the present invention.

FIG. 1 is a schematic diagram of a constant current source, generally designated 100, in accordance with an embodiment of the present invention. The current source 100 generally includes a bandgap reference circuit 102, a resistor 114, and an output circuit 116. The output circuit 116 is illustrated in the embodiment of FIG. 1 as p-type field effect transistor (pFET), however, it will be appreciated that other examples of output circuit 116 including different circuits than shown in FIG. 1 may be used in other embodiments of the invention.

The bandgap reference circuit 102 may generally be any bandgap reference and provide a reference voltage (an output voltage). In some embodiments, the bandgap reference circuit 102 may provide a reference voltage of 1.25V. In the embodiment of FIG. 1, the bandgap reference circuit 102 includes an amplifier 104, an output transistor 106, resistors 120, and diodes 122A and B (collectively referred to as "diodes 122"). The diodes 122 (resistive elements) may exhibit a temperature dependency, such as having a current that varies based on the temperature. In some embodiments, the diodes 122 exhibit an increasing current for increasing temperature. In other words, resistance values of the diodes 122 may represent negative temperature coefficients. In various embodiments, the amplifier 104 may be an operational transconductance amplifier (OTA) or an operational amplifier (op-amp). The amplifier 104 includes non-inverting (+) and inverting (−) inputs, and an output, and is configured to provide an output based on the inputs provided to the non-inverting and inverting inputs. Those skilled in the art will appreciate that embodiments implemented with an op-amp may further include compensation components, such as capacitors. The output transistor 106 is illustrated in the embodiment of FIG. 1 as a pFET, but other transistors may be used in other embodiments.

In the depicted embodiment, the output of the amplifier 104 is coupled to the gate of the output transistor 106. The source of the output transistor 106 is coupled to a supply voltage $V_{PP}$. The drain of the output transistor 106 may be coupled a node 124 (a current output node) and provide to an output signal 108. In the depicted embodiment, a first branch 130 of the node 124 provides a feedback signal 110, which may carry a constant voltage of 1.25V, and a current that is proportional to absolute temperature ("PTAT"), $I_{PTAT}$ (a first current). Those skilled in the art will appreciate that $I_{PTAT}$ increases as temperature increases, as discussed in further detail below with respect to FIG. 4.

The current, $I_{PTAT}$, may be determined based on components to which the feedback signal 110 is provided. In the depicted embodiment, the feedback signal 110 is provided to a positive feedback loop 126 (a first current path) and a negative feedback loop 128 (a second current path). The positive feedback loop 126 includes two resistors 120 and a diode 122B coupled in series to ground. The resistors 120 may have an associated resistance, $R_1$. The resistance, $R_1$ may represent a positive temperature coefficient. The non-inverting input of the amplifier 104 is coupled to a node between the two series resistors 120 in the positive feedback loop 126 and receives an input voltage $V_{IN2}$. The negative feedback loop 128 includes a resistor 120, having resistance $R_1$, and a diode 122A coupled in series to ground. The inverting input of the amplifier 104 is coupled to the negative feedback loop 128 between the resistor 120 and the diode 122 and receives an input voltage $V_{IN1}$. The current, $I_{PTAT}$, of the feedback signal 110 may be determined based on Ohm's Law, $I_{PTAT}=2\times\Delta V/R_1$ where $\Delta V$ is the difference between $V_{BE1}$ and $V_{BE2}$ which are voltages of diodes 122A and 122B, respectively and depends on the values of the diodes 122A and 122B. For example, as previously discussed, the diodes 122A and 122B may exhibit an increasing current for increasing temperature. As a result, $\Delta V$ may be directly proportional to temperature (e.g., $V\propto kT/q$, where k is Boltzmann's constant, T is the absolute temperature, and q is the magnitude of the electron charge). Therefore, $I_{PTAT}$ may also be directly proportional to temperature (as indicated by the acronym PTAT). Those skilled in the art will appreciate that the bandgap reference circuit 102 depicted in FIG. 1 is provided merely as an example, and other bandgap reference circuits may be used without departing from the scope of this disclosure.

A second branch 112 of the node 124 is coupled to a resistor 114 having a resistance, $R_2$, and to ground. The resistance, $R_2$, may represent a positive temperature coefficient. The second branch of the node 124 may provide a current that is complementary to absolute temperature ("CTAT"), $I_{CTAT}$ (a second current). The current, $I_{CTAT}$, is equal to the voltage at the node 124 (e.g., 1.25V) divided by the resistor 114 (e.g., $R_2$). In various embodiments, the resistance $R_2$ of resistor 114 may be selected such that the current, $I_{CTAT}$, has an opposite temperature dependence to the current $I_{PTAT}$. For example, $I_{PTAT}$ may linearly increase with temperature (e.g., $I_{PTAT}$ increases by 0.1 μA per 100K). In such a case, the resistor 114 is selected such that the current through the resistor 114, $I_{CTAT}$, decreases at the same rate (e.g., $I_{CTAT}$ decreases by 0.1 μA per 100K). In one embodiment, the resistor 114 may have a resistance $R_2$=225 kΩ. By providing currents $I_{PTAT}$ and $I_{CTAT}$ to have equal and opposite temperature dependencies, the current of the output signal 108 (the output current $I_{STAB}$) may remain constant over varying temperatures at $I_{STAB}$. That is, as the temperature increases, the current through the feedback signal 110 increases and the current through the second branch 112 decreases at the same rate. Therefore, because the sum of $I_{PTAT}$ and $I_{CTAT}$ (e.g., the total current leaving the node 124) is constant with temperature, the current of the node 124 (e.g., $I_{STAB}$) is also constant with temperature.

The output of the amplifier 104 may also be coupled to the output circuit 116. The output circuit 116 may have a source coupled to the supply voltage, $V_{PP}$, and provide an output signal 118 (an output current $I_{OUT}$) at the drain having a current, $I_{OUT}$. In the depicted embodiment, the output circuit 116 is configured as a current mirror with the transistor 106. That is, $I_{OUT}$ is the mirror current of $I_{STAB}$. In some embodiments, the output circuit 116 and the transistor 106 may be matched (e.g., have the same electrical characteristics and performance). In other embodiments, the channel size (a ratio of the channel width to the channel length) of the output circuit 116 may be adjusted relative to that of the output transistor 106 to compensate for differences between the current of the output signal 118 and the output signal 108. In some embodiments, the channel size of the output circuit 116 may be N times greater or less than that of the output transistor 106 in order to cause $I_{OUT}$ to be N times greater or less than $I_{STAB}$. By selecting the resistor, $R_2$, of the resistor 114 to create a current, $I_{CTAT}$, that complements the temperature variability of the current $I_{PTAT}$, and mirroring the current, $I_{STAB}$, of the output signal 108 to the current, $I_{OUT}$, of the output signal 118, the current source 100 provides a temperature independent, constant current output which may be provided to any other component or circuit that requires a constant current source.

Figure 2:
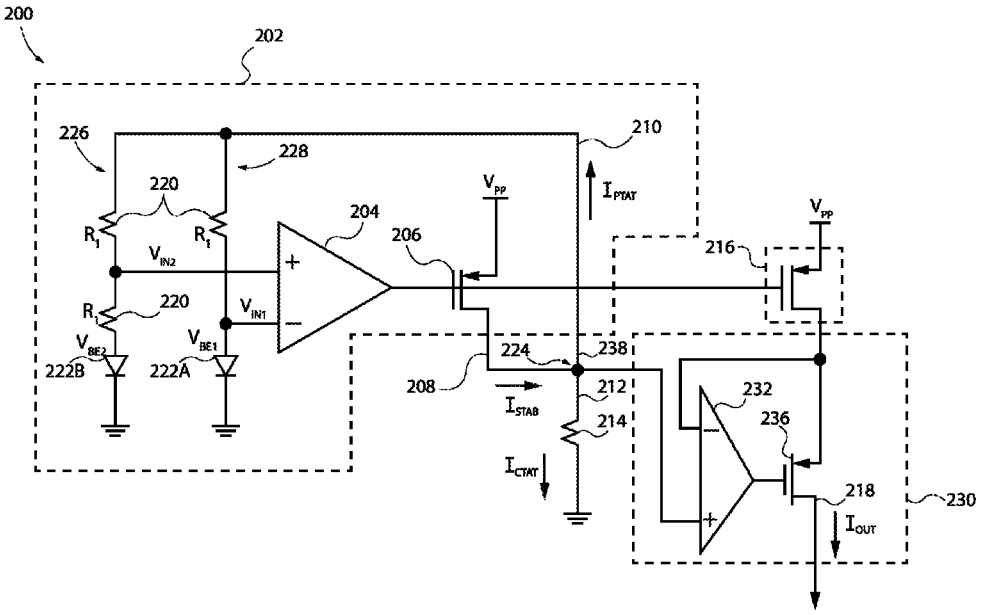
FIG. 2 is a schematic diagram of a constant current source with a current mirror circuit, in accordance with an embodiment of the present invention.

FIG. 2 is a schematic diagram of a constant current source, generally designated 200, in accordance with an embodiment of the present invention. The current source 200 generally includes a bandgap reference circuit 202, a resistor 214, an output circuit 216, and a current mirror circuit 230. The output circuit 216 is illustrated in the embodiment of FIG. 2 as p-type field effect transistor (pFET), however, it will be appreciated that other examples of output circuit 216 including different circuits than shown in FIG. 2 may be used in other embodiments of the invention.

In various embodiments, the bandgap reference circuit 202 may be implemented as the bandgap reference circuit 102 described above with respect to FIG. 1. For instance, the amplifier 204 may be implemented as the amplifier 104, the output transistor 206 may be implemented as the output transistor 106 to provide an output signal 208. As described above with respect to the node 124, a first branch 238 of the node 224 may provide a feedback signal 210 to a positive feedback loop 226 and a negative feedback loop 228. The positive feedback loop may include resistors 220 and a diode 222B, which may be implemented as resistors 120 and diode 122B, as described above with respect to FIG. 1. The negative feedback loop 228 may include a resistor 220 and a diode 222A, which may be implemented as resistor 120 and diode 122A, as described above with respect to FIG. 1. Each of the positive and negative feedback loops 226 and 228 may be coupled to the amplifier 204 as described above with respect to the positive and negative feedback loops 126 and 128 in FIG. 1. A second branch 212 of the node 224 may include the resistor 214, which may be implemented as described above with respect to the resistor 114 to have a current $I_{CTAT}$ to complement the current, $I_{PTAT}$ on the feedback signal 210. The output of the amplifier 204 may be provided to the output circuit 216 as described above with respect to the output circuit 116.

The current mirror circuit 230 provides an output current, $I_{OUT}$, that is based on the temperature independent current, $I_{STAB}$ provided by the output transistor 206. The current mirror circuit 230 may include an amplifier 232 and a transistor 236. In one embodiment, the amplifier 232 is an OTA. The transistor 236 is illustrated in the embodiment of FIG. 2 as pFET, however, it will be appreciated that other circuits may be used in other embodiments of the invention. The transistor 236 may be matched to the transistors 206 and a transistor of the output circuit 216. The amplifier 232 may have a non-inverting input terminal coupled to the node 224. As described above with respect to node 124 in FIG. 1, node 224 may have a constant voltage equal to the bandgap reference voltage (e.g., 1.25V). The inverting input of the amplifier 232 may be coupled to the output circuit 216, which provides a constant voltage equal to the bandgap reference voltage, $V_{bgr}$=1.25. The output of the amplifier 232, is coupled to the transistor 218. The source of the transistor 236 may be coupled to the output circuit 216, and the drain of the transistor 236 may provide an output signal 218 having a current, $I_{OUT}$. In the depicted embodiment, the current mirror circuit 230 mirrors the current, $I_{STAB}$, from the drain of the transistor 206 to the current of the output signal 218, $I_{OUT}$. The amplifier 232 provides a voltage at a gate of the transistor 236 to maintain the source of the transistor 236 at the same voltage of the node 224, thereby ensuring that the current $I_{OUT}$ is the same as the current $I_{STAB}$. If the voltage at the source of the transistor 236 varies, the amplifier 232 adjusts the voltage provided to the gate of the transistor 236 to return the source voltage to that of the node 224. Those skilled in the art will appreciate that in embodiments where the transistor of the output circuit 216 is the same as the output transistor 206, a signal provided by the output circuit 216 may not mirror the current of the output signal 208. Therefore, it may be beneficial to include the current mirror 230 to ensure that the output current of the current source 200 mirrors the current of the output signal 208.

Figure 3A:
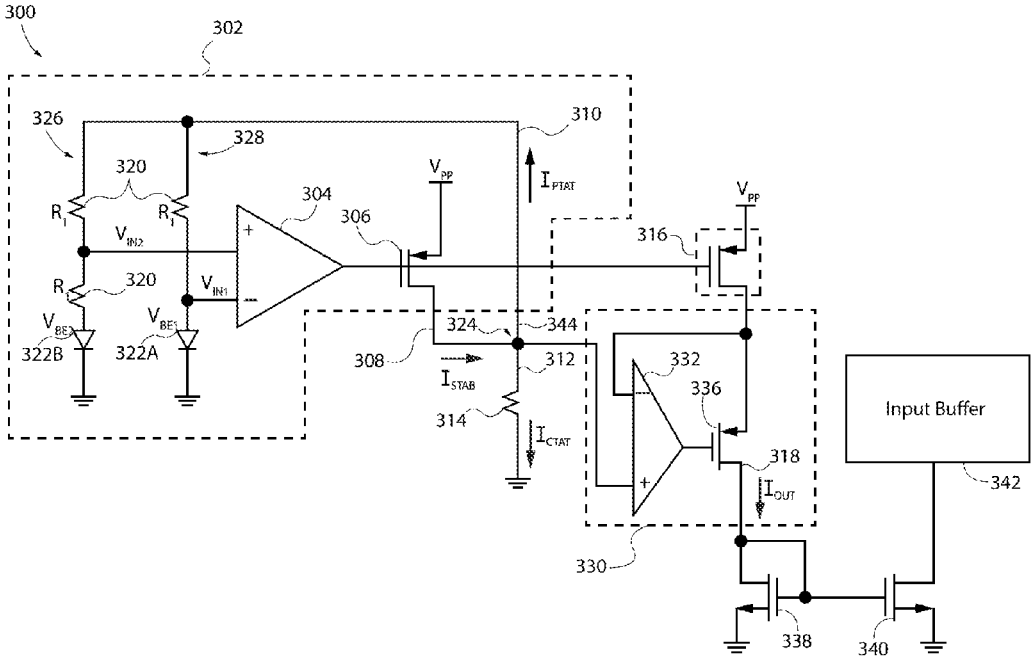
FIG. 3A is a schematic diagram of a constant current source connected to an input buffer, in accordance with an embodiment of the present invention.

FIG. 3A is a schematic diagram of a constant current source, generally designated 300, coupled to an input buffer 342, in accordance with an embodiment of the present invention. Those skilled in the art will appreciate that the input buffer 342 may be replaced by a delay circuit, an oscillator, or any other circuit that can be implemented with a current source having reduced temperature dependence. In various embodiments, the output of the current sources 100, 200, and 300 may be coupled to any type of circuit that uses a constant current. The current source 300 generally includes a bandgap reference circuit 302, a resistor 314, and output circuit 316, and a current mirror circuit 330, which provides a current to the input buffer 342 via a current mirror circuit including transistors 338 and 340.

In various embodiments, the bandgap reference circuit 302 may be implemented as described above with respect to bandgap reference circuits 102 and 202. The bandgap reference circuit 302 may include an amplifier 304, a transistor 306 coupled to the output of the amplifier 304. The transistor 306 may have a source coupled to a voltage, $V_{PP}$, and may provide an output signal 308 having a current, $I_{STAB}$, that is provided to a node 324. A first branch 344 of the node 324 may provide a feedback signal 310, having a current, $I_{PTAT}$, that is coupled to a positive feedback loop 326 and a negative feedback loop 328. The positive feedback loop may include two resistors 320 and a diode 322B coupled in series to ground. A non-inverting input of the amplifier 304 may be coupled to the positive feedback loop 326 between the resistors 320 and provide a voltage, $V_{IN2}$. The negative feedback loop 328 may include a resistor 320 coupled in series with a diode 322A to ground. An inverting input of the amplifier 304 is coupled to the resistor 320 and is provided a voltage, $V_{IN1}$.

A second branch of the node 324 may be coupled through a resistor 314 to ground. The current through the resistor 314 may be complementary to absolute temperature and have a value, $I_{CTAT}$. In various embodiments, the current $I_{CTAT}$ decreases as temperature increases. The current, $I_{PTAT}$, provided on feedback signal 310 increases with temperature. The currents $I_{CTAT}$ and $I_{PTAT}$ change with temperature at equal and opposite rates. Therefore, because $I_{CTAT}$ and $I_{PTAT}$ complement each other with changing temperature, the input current, $I_{STAB}$, remains constant with changing temperature.

The current, $I_{STAB}$, is mirrored to the output circuit 316, which is coupled to the output of the amplifier 304. The output circuit 316 is further coupled to the voltage $V_{pp}$. The output circuit 316 may be coupled to a current mirror circuit 330. The current mirror circuit 330 may be implemented as the current mirror circuit 230, as described above with respect to FIG. 2. The current mirror circuit 330 may include an amplifier 332 and a transistor 336. The output circuit 316 may be coupled to an inverting input of the amplifier 332 and to a source of the transistor 336. The non-inverting input of the amplifier 332 may be coupled to the node 324. The output of the amplifier 332 is provided to the gate of the transistor 336, which provides an output signal 318. The output signal 318 has a current, $I_{OUT}$, which is equal to the current, $I_{STAB}$. The output signal 318 may be provided to diode coupled transistor 338, which is coupled to the gate of a second transistor 340. The transistor 340 may provide a constant current signal to the input buffer 342 mirrored by the transistors 338 and 340 based on the current $I_{OUT}$ provided by the current mirror circuit 330. In the embodiment of FIG. 3, a particular application of the current source 300 is shown as a bias current to an input buffer. For example, the input buffer 342 may be an input buffer for a dynamic random access memory (DRAM) device as discussed in further detail below with respect to FIG. 6.

Figure 3B:
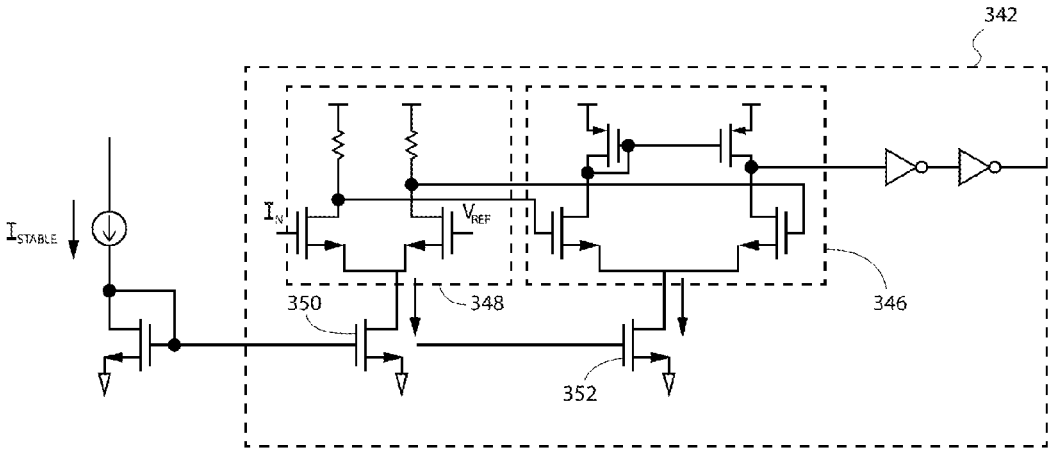
FIG. 3B is a schematic diagram of an input buffer, in accordance with the embodiment of FIG. 3A.

FIG. 3B is a schematic diagram of the input buffer 342, in accordance with the embodiment of FIG. 3A. In the embodiment of FIG. 3B, the input buffer 342 is a two stage input buffer configured to receive a bias signal from the current source 300 in FIG. 3A. The input buffer 342 generally includes a first buffer stage 348, a second buffer stage 346, and mirror transistors 350 and 352. As discussed above with respect to FIG. 3A, the output signal 318, which may have reduced temperature dependency, may be mirrored to the input buffer 342 by transistors 338 and 340. The output signal 318 may provide a biasing signal to the mirror transistors 350 and 352. In the embodiment of FIG. 3B, the mirror transistor 350 may mirror the output signal 318 to the first buffer stage 348. The first buffer stage 350 may be configured to receive an input signal, $I_N$, and a reference signal $V_{REF}$ and provide an output signal to the second stage 346 based on the output signal 318. The second stage 346 may be configured to receive signals from the first stage 348 and provide a buffered signal based on the output signal 318 provided to the mirror transistor 352.

Figure 4:
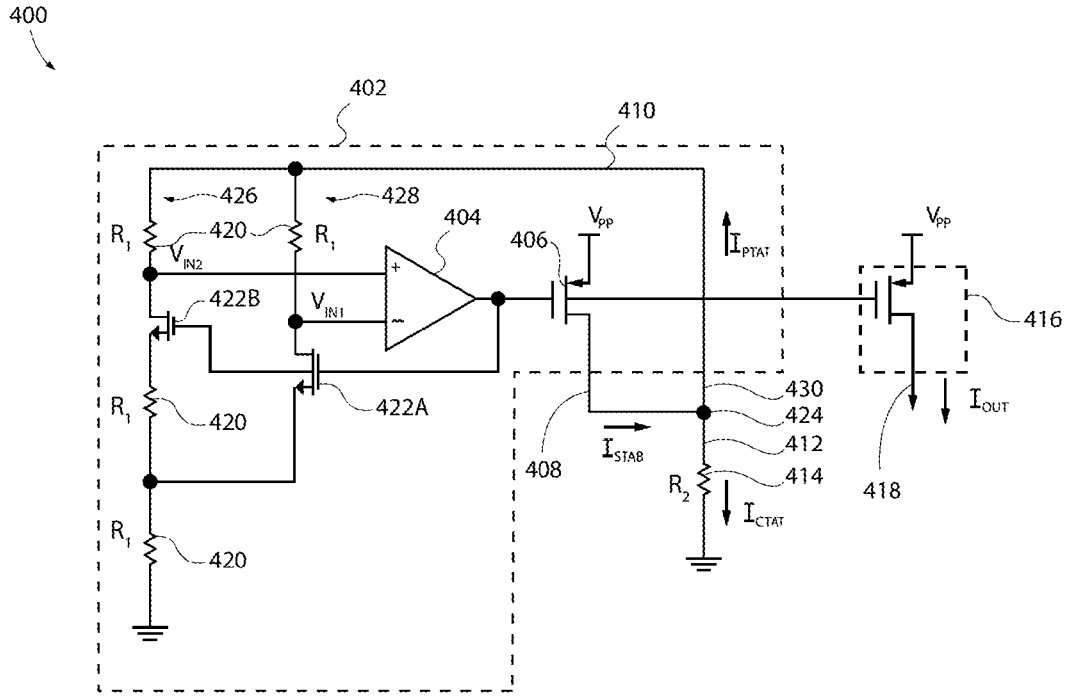
FIG. 4 is a schematic diagram of a constant current source, in accordance with an embodiment of the present invention.

FIG. 4 is a schematic diagram of a current source, generally designated 400, in accordance with an embodiment of the present invention. The current source 400 may include a bandgap reference circuit 402, a resistor 414, and an output circuit 416. The bandgap reference circuit 402 may include an amplifier 404, an output transistor 406, resistors 420 having resistances, $R_1$, and transistors 422A and 422B. In the depicted embodiment, the amplifier 404 provides a signal to the output transistor 406 and the transistors 422A and 422B. The output transistor 406 may receive a voltage, $V_{PP}$, and provide an output signal 408 to a node 424 based on the output signal of the amplifier 404 and the voltage, $V_{PP}$. The node 424 may be coupled to a first branch 430 and a second branch 412. The first branch may provide a feedback signal 410, which may carry a current, $I_{PTAT}$, which is proportional to absolute temperature.

The feedback signal 410 may be provided to the resistors 420 in a positive feedback loop 426 and a negative feedback loop 428. The positive feedback loop 426 may include a resistor 420 coupled in series to the transistor 422A, and two additional resistors 420. The positive feedback loop 426 may provide a signal $V_{IN2}$ to a non-inverting input of the amplifier 404. The negative feedback loop 428 may include a resistor 420 coupled in series to the transistor 422B and a resistor 420. The negative feedback loop 428 may provide a signal $V_{IN1}$ to an inverting input of the amplifier 404.

The second branch 412 may include a resistor 414 having a resistance $R_2$ coupled to ground. The resistance $R_2$ may be selected such that the current, $I_{CTAT}$, through the resistor 414 is complementary to absolute temperature. That is, the current $I_{CTAT}$ through the resistor 414 has temperature dependency that is equal in magnitude and opposite in direction to the temperature dependency of the feedback signal 410. Because the currents $I_{PTAT}$ and $I_{CTAT}$ through the first branch 430 and second branch 412 have equal and opposite temperature dependency, the current $I_{STAB}$ through the output signal 408 may demonstrate reduced temperature dependency.

The output signal of the amplifier 404 may also be provided to an output circuit 416 which may include, for example, a transistor having similar channel size to the output transistor 406. The output circuit 416 may provide an output signal 418 having a current, $I_{OUT}$. In some embodiments, the current of the output signal 418 may mirror the current of the output signal 408. That is, the current $I_{OUT}$ may have reduced temperature dependency compared to traditional current sources. In other embodiments, the transistor in the output circuit 416 may have a channel size that is adjusted relative to the channel size of the output transistor 406 such that the current of the output signal 418 mirrors the current of the output signal 408. As described above with respect to FIG. 1, the output signal 418 may be provided to any of a number of circuits including input buffers, oscillator circuits, delay circuits, or any other type of circuit that may benefit from a signal having reduced temperature dependence.

Figure 5:
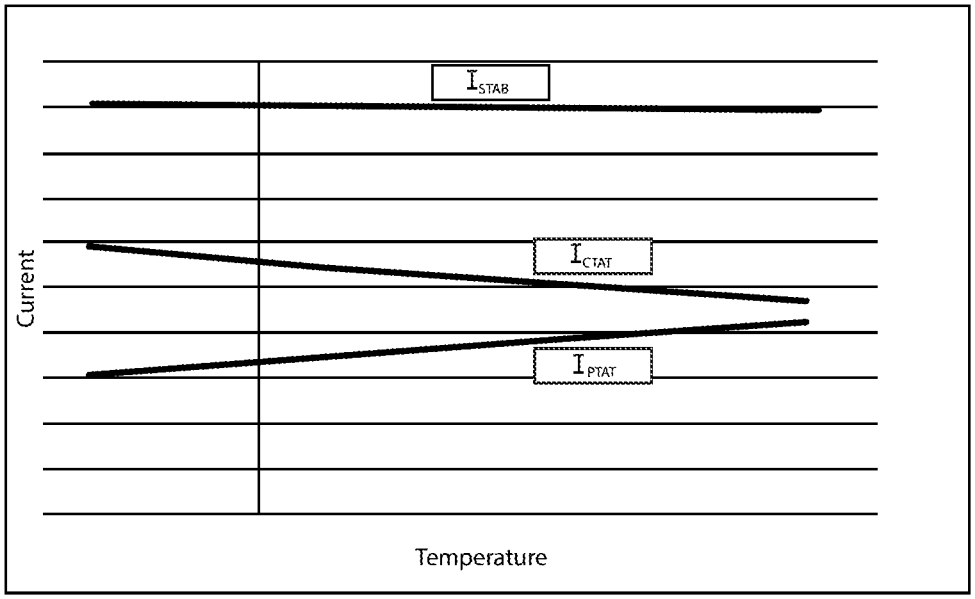
FIG. 5 is a graph depicting the output currents of a constant current source, in accordance with an embodiment of the present invention.

FIG. 5 is a graph depicting the output currents of a temperature independent constant current source, in accordance with an embodiment of the present invention. The graph shows temperature on the horizontal axis and current on the vertical axis. As described above, $I_{PTAT}$ is proportionally related to temperature, such that the current increases as temperature increases. $I_{CTAT}$ is inversely proportionally related to temperature, such that current decreases as temperature increases. The temperature dependencies of $I_{PTAT}$ and $I_{CTAT}$ are equal and opposite such that when $I_{PTAT}$ and $I_{CTAT}$ are added together, a temperature independent, constant current, $I_{STAB}$, is produced. The temperature independent, constant current, $I_{STAB}$, may be provided to any electrical components that benefit from the use of a temperature independent, constant current.

Figure 6:
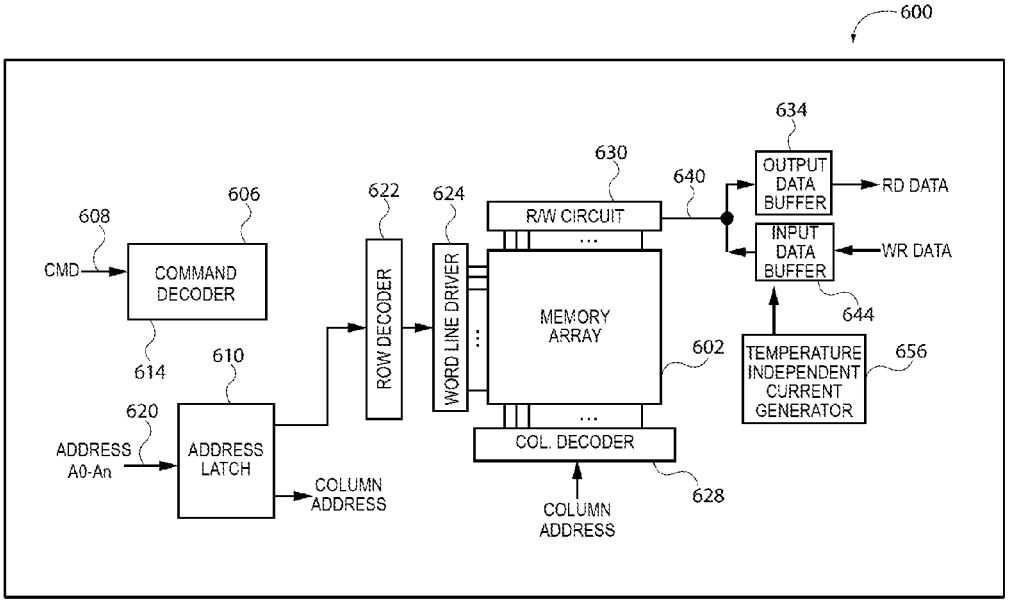
FIG. 6 is a block diagram of a memory, in accordance with an embodiment of the present invention.

FIG. 6 is a block diagram of a memory, according to an embodiment of the invention. The memory 600 may include an array 602 of memory cells, which may be, for example, volatile memory cells (e.g., dynamic random-access memory (DRAM) memory cells, static random-access memory (SRAM) memory cells), non-volatile memory cells (e.g., flash memory cells), or some other types of memory cells. The memory 600 includes a command decoder 606 that may receive memory commands through a command bus 608 and provide (e.g., generate) corresponding control signals within the memory 600 to carry out various memory operations. For example, the command decoder 606 may respond to memory commands provided to the command bus 608 to perform various operations on the memory array 602. In particular, the command decoder 606 may be used to provide internal control signals to read data from and write data to the memory array 602. Row and column address signals may be provided (e.g., applied) to an address latch 610 in the memory 600 through an address bus 620. The address latch 610 may then provide (e.g., output) a separate column address and a separate row address.

The address latch 610 may provide row and column addresses to a row address decoder 622 and a column address decoder 628, respectively. The column address decoder 628 may select bit lines extending through the array 602 corresponding to respective column addresses. The row address decoder 622 may be connected to a word line driver 624 that activates respective rows of memory cells in the array 602 corresponding to received row addresses. The selected data line (e.g., a bit line or bit lines) corresponding to a received column address may be coupled to a read/write circuit 630 to provide read data to an output data buffer 634 via an input-output data path 640. Write data may be provided to the memory array 602 through an input data buffer 644 and the memory array read/write circuit 630. The input data buffer 644 may receive a signal from a constant current source according to an embodiment of the present invention, for example, a constant current source as described above with respect to FIGS. 1-4. For example, the input data buffer 644 may use a constant current bias in one or more input buffer stages.

Those of ordinary skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Skilled artisans may implement the described functionality in varying ways for each particular application, but such implementation decisions should not be interpreted as causing a departure from the scope of the present disclosure.

What is claimed is:

1. An apparatus comprising:

a bandgap reference circuit comprising:

an amplifier including first and second inputs and an output; and a bandgap transistor coupled to the output of the amplifier at a control electrode thereof, the bandgap transistor being further coupled commonly to the first and second inputs of the amplifier at a first electrode thereof to form a feedback path;

an output transistor coupled to the output of the amplifier at a control electrode thereof and configured to provide, at a first electrode thereof, a third current that is substantially constant relative to changing temperature;

a current mirror circuit coupled to the output transistor to receive the third current and to the first electrode of the bandgap transistor, the current mirror circuit configured to provide a current mirror signal that is based on a current provided by the bandgap transistor; and a resistor coupled to the first electrode of the bandgap transistor.

2. The apparatus of claim 1, wherein the bandgap transistor is configured to provide the feedback path with a first current that is proportional to temperature, and the bandgap transistor is further configured to provide the resistor with a second current that is complementary to temperature.

3. The apparatus of claim 1, wherein the amplifier is an operational transconductance amplifier.

4. The apparatus of claim 1, wherein the current mirror signal is provided to at least one of an input buffer, an oscillator, and a delay circuit.

5. The apparatus of claim 1, wherein the feedback path comprises:

a positive feedback branch coupled to the first input of the amplifier, wherein the first input of the amplifier is a non-inverting input; and a negative feedback branch coupled to the second input of the amplifier, wherein the second input of the amplifier is an inverting input of the amplifier.

6. An apparatus, comprising:

a feedback path configured to generate first and second input voltages responsive to a first current;

an amplifier configured to receive the first and second input voltages and provide an amplifier output voltage responsive to the first and second input voltages, the amplifier output voltage being substantially constant irrelative to changing temperature;

a first resistor; and a first transistor configured to provide a first output current responsive to the amplifier output voltage, the first output current including the first current that is proportional to temperature and a second current that is complementary to temperature, the transistor being further configured to provide the first current to the feedback path and the second current to the first resistor, wherein the first resistor represents a positive temperature coefficient and the second current flows through the first resistor, wherein the first resistor is configured to provide the second current that decreases at the same rate as the first current linearly increases with temperature to provide a first output current that is substantially constant with varying temperature.

7. The apparatus of claim 6, further comprising a second transistor having a gate coupled to the amplifier output voltage and configured to provide a second output current.

8. The apparatus of claim 6, wherein the first output current is substantially equal to a sum of the first and second current.

9. The apparatus of claim 6, wherein the feedback path comprises:

a first branch including a first diode and second and third resistors that are coupled in series to one another; and a second branch including a second diode and a fourth resistor that are coupled in series to each other.

10. An apparatus comprising:

a bandgap reference circuit configured to provide a reference voltage that is substantially constant irrelative to changing temperature, and comprises:

a first transistor coupled between a power line and a current output node, the first transistor received the reference voltage at a control node thereof;

a first current path including a first resistive element having a resistance value of which represents a first negative temperature coefficient and coupled to the current output node;

a second current path coupled to the current output node of the bandgap reference circuit and the second current path including a second resistive element having a resistance value of which represents a second negative temperature coefficient; and a first amplifier including first and second inputs coupled respectively to the first and second current paths;

a second transistor coupled to the power line at a first node thereof and configured to receive the reference voltage at a control node thereof;

a second amplifier circuit including a third input coupled to the current output node of the bandgap reference circuit and including a fourth input coupled to a second node of the second transistor;

a third transistor coupled between the second terminal of the second transistor and a first circuit node and coupled to an output of the second amplifier at a control node thereof; and a first resistor coupled to the current output node of the bandgap reference circuit, a resistance value of the first resistor representing a first positive temperature coefficient.

11. The apparatus of claim 10, wherein the first current path further includes second and third resistors coupled in series to the first resistive element, resistance values of the second and third resistors represent second and third positive temperature coefficients, respectively, the second current path further includes a fourth resistor coupled in series to the second resistive element, a resistance value of the fourth resistor represent a fourth positive temperature coefficient.

12. The apparatus of claim 11, wherein the first current path is coupled to the first input of the amplifier at a first circuit node at which the second and the third resistors are coupled and the second current path is coupled to the second input of the amplifier at a second circuit node at which the fourth resistor and the second resistive element are coupled.

13. The apparatus of claim 10, further comprising an input buffer coupled to the first circuit node.

14. The apparatus of claim 10, wherein the bandgap reference circuit configured to provide the current output node with an output current that is substantially constant irrespective to changing temperature.

15. The apparatus of claim 10, wherein the first resistive element includes a diode.

* * * * *